US010033111B2

(12) United States Patent
Timofeev et al.

(10) Patent No.: US 10,033,111 B2
(45) Date of Patent: Jul. 24, 2018

(54) WIDEBAND TWIN BEAM ANTENNA ARRAY

(71) Applicant: Commscope Technologies, LLC, Hickory, NC (US)

(72) Inventors: Igor E. Timofeev, Dallas, TX (US); Gangyi Deng, Allen, TX (US)

(73) Assignee: CommScope Technologies LLC, Hickory, NC (US)

( * ) Notice: Subject to any disclaimer, the term of this patent is extended or adjusted under 35 U.S.C. 154(b) by 563 days.

(21) Appl. No.: 14/329,503

(22) Filed: Jul. 11, 2014

(65) Prior Publication Data

US 2016/0013563 A1 Jan. 14, 2016

Related U.S. Application Data

(60) Provisional application No. 61/845,616, filed on Jul. 12, 2013.

(51) Int. Cl.

| | |
|---|---|
| ***H01Q 21/00*** | (2006.01) |
| ***H01Q 21/22*** | (2006.01) |
| ***H01Q 3/22*** | (2006.01) |
| ***H01Q 3/34*** | (2006.01) |

(52) U.S. Cl.

CPC ..... *H01Q 21/0075* (2013.01); *H01Q 3/22* (2013.01); *H01Q 3/34* (2013.01); *H01Q 21/22* (2013.01)

(58) Field of Classification Search

CPC ..... H01Q 21/0075
USPC ..... 343/853
See application file for complete search history.

(56) References Cited

U.S. PATENT DOCUMENTS 3,623,098 A * 11/1971 Jones ..... G01S 7/28 342/103
4,583,061 A * 4/1986 O'Shea ..... H01Q 25/008 333/109
4,612,548 A * 9/1986 Beltran ..... H01P 5/12 342/373

(Continued)

FOREIGN PATENT DOCUMENTS

CN 102834968 12/2012
WO WO 2012/065622 A1 5/2012

OTHER PUBLICATIONS

Wu et al; An Unequal Wilkinson Power Divider for a Frequency and Its First Harmonic; IEEE Microwave and Wireless Components Letters, vol. 18; No. 11; Nov. 2008;.*

(Continued)

*Primary Examiner* — Dameon E Levi
*Assistant Examiner* — Ab Salam Alkassim, Jr.
(74) *Attorney, Agent, or Firm* — Myers Bigel, P.A.

(57) ABSTRACT

A wideband antenna includes a plurality of radiating elements arranged in an array and a feed network. The feed network includes at least one frequency dependent power divider for varying the amplitude of a signal provided to at least two of the plurality of radiating elements as a function of a frequency of a signal. The feed network may further comprise a plurality of inputs and the antenna may produce a plurality of beams. The frequency dependent divider may comprise a power divider having a first output and a second output, a 90° hybrid, having a first input coupled to the first output of the power divider, and a second input, and a delay line, coupled between the second output of the power divider and the second input of the 90° hybrid.

23 Claims, 9 Drawing Sheets

(56) References Cited

U.S. PATENT DOCUMENTS 4,827,270 A * 5/1989 Udagawa ..... H01Q 19/17 333/116
5,400,363 A * 3/1995 Waugh ..... H04L 27/2273 329/308
5,459,474 A * 10/1995 Mattioli ..... H01Q 21/0087 343/702
6,249,249 B1 * 6/2001 Obayashi ..... H01Q 3/34 342/371
6,292,070 B1 * 9/2001 Merrill ..... H01P 5/10 333/25
6,552,692 B1 4/2003 Zeilinger et al.
6,564,160 B2 * 5/2003 Jungerman ..... G01R 13/345 331/172
6,868,043 B1 * 3/2005 Berkman ..... H01Q 3/26 342/371
7,265,558 B1 * 9/2007 Penndal ..... G01F 23/284 324/637
7,324,060 B2 * 1/2008 Quan ..... H01P 5/16 333/125
7,498,999 B2 * 3/2009 Shtrom ..... H01P 1/185 333/139
8,237,619 B2 * 8/2012 Vassilakis ..... H01Q 3/40 343/836
8,295,212 B2 * 10/2012 Carney ..... H04B 1/52 370/280
8,988,147 B2 * 3/2015 Liu ..... H03F 3/68 330/124 R
9,425,840 B2 * 8/2016 Kintis ..... H04B 1/1036
9,899,736 B2 * 2/2018 Ho ..... H01Q 3/38
2003/0034917 A1 2/2003 Nishizawa
2003/0052834 A1 * 3/2003 Sievenpiper ..... H01Q 21/245 343/909
2005/0035825 A1 * 2/2005 Carson ..... H01Q 21/0025 333/117
2007/0091008 A1 * 4/2007 Mortazawi ..... H01Q 3/26 343/864
2008/0143632 A1 6/2008 Apostolos
2009/0278599 A1 * 11/2009 Pengelly ..... H03F 3/604 330/124 R
2010/0007573 A1 * 1/2010 Kuramoto ..... H01Q 25/005 343/843
2011/0102262 A1 * 5/2011 Haskell ..... H01Q 1/246 342/372
2011/0109524 A1 * 5/2011 Saily ..... H01Q 21/08 343/893
2011/0205119 A1 * 8/2011 Timofeev ..... H01Q 1/246 342/373
2012/0293380 A1 11/2012 Apostolos et al.
2012/0319919 A1 * 12/2012 Kirovski ..... H01Q 1/243 343/853
2013/0169505 A1 * 7/2013 Shmuel ..... H01Q 1/088 343/848
2013/0235806 A1 * 9/2013 Nilsson ..... H01Q 1/246 370/328

OTHER PUBLICATIONS

International Preliminary Report on Patentability regarding international application PCT/CN2012/087300; dated Mar. 18, 2015 (24 pgs.).
International Search Report regarding nternational application PCT/CN2012/087300; dated Oct. 3, 2013 (2 pgs.).
European Patent Office Search Report regarding EP12881985.1; dated May 19, 2015 (6 pgs.).
International Search Report regarding PCT/US2014/046325, dated Sep. 26, 2014 (6pgs.).
Writent Opinion regarding PCT/US2014/046325, dated Sep. 26, 2014 (10pgs.).
Ouacha et al., "Wideband Antenna Arrays with Reconfigurable Beamforming and Beamshaping," Microwave Symposium, Jun. 2007, pp. 1867-1870 (4 pages).
Liu et al., "Design of Compact Dual-Band Power Dividers With Frequency-Dependent Division Ratios Based on Multisection Coupled Line," IEEE vol. 3, No. 3, Mar. 1, 2013 pp. 467-475.
Notification Concerning Transmittal of International Preliminary Report on Patentability in corresponding PCT Application No. PCT/US2014/046325 dated Jan. 21, 2016 (11 pages).

* cited by examiner

| Frequency, GHz | | 1.7 | 2.2 | 2.7 | 1.7 | 2.2 | 2.7 | 1.7 | 2.2 | 2.7 |
|---|---|---|---|---|---|---|---|---|---|---|
| Beam 1 | Amplitude | 0.7 | 0.36 | 0.14 | 1 | 1 | 1 | 0.7 | 0.88 | 0.98 |
| | Phase, deg. | 0 | 0 | 0 | -90 | -90 | -90 | 180 | 180 | 180 |
| Beam 2 | Amplitude | 0.7 | 0.36 | 0.14 | 1 | 1 | 1 | 0.7 | 0.88 | 0.98 |
| | Phase, deg. | -90 | -90 | -90 | 0 | 0 | 0 | 90 | 90 | 90 |

| Frequency, GHz | | 1.7 | 2.2 | 2.7 | 1.7 | 2.2 | 2.7 | 1.7 | 2.2 | 2.7 | 1.7 | 2.2 | 2.7 |
|---|---|---|---|---|---|---|---|---|---|---|---|---|---|
| Beam 1 | Amplitude | 0.6 | 0.45 | 0 | 0 | 0.42 | 0.6 | 1 | 1 | 1 | 0.6 | 0.6 | 0.6 |
| | Phase, deg. | 0 | 0 | 0 | 0 | 0 | 0 | −90 | −90 | −90 | 180 | 180 | 180 |
| Beam 2 | Amplitude | 0.6 | 0.42 | 0 | 0 | 0.42 | 0.6 | 1 | 1 | 1 | 0.6 | 0.6 | 0.6 |
| | Phase, deg. | −90 | −90 | −90 | −90 | −90 | −90 | 0 | 0 | 0 | 90 | 90 | 90 |

| Frequency, GHz | | 1.7 | 2.2 | 2.7 | 1.7 | 2.2 | 2.7 | 1.7 | 2.2 | 2.7 | 1.7 | 2.2 | 2.7 | 1.7 | 2.2 | 2.7 |
|---|---|---|---|---|---|---|---|---|---|---|---|---|---|---|---|---|
| Beam 1 | Amplitude | 0.55 | 0.36 | 0 | 0.25 | 0.45 | 0.6 | 1 | 1 | 1 | 0.25 | 0.45 | 0.6 | 0.55 | 0.36 | 0 |
| | Phase, deg. | 0 | 0 | 0 | 0 | 0 | 0 | −90 | −90 | −90 | 180 | 180 | 180 | 180 | 180 | 180 |
| Beam 2 | Amplitude | 0.55 | 0.36 | 0 | 0.25 | 0.45 | 0.6 | 1 | 1 | 1 | 0.25 | 0.45 | 0.6 | 0.55 | 0.36 | 0 |
| | Phase, deg. | −90 | −90 | −90 | −90 | −90 | −90 | 0 | 0 | 0 | 90 | 90 | 90 | 90 | 90 | 90 |

WIDEBAND TWIN BEAM ANTENNA ARRAY

RELATED APPLICATIONS

This application claims priority to U.S. Provisional Patent Application No. 61/845,616, filed Jul. 12, 2013 and titled "Wideband Twin Beam Antenna Array", the entire disclosure of which is incorporated by reference.

FIELD OF THE INVENTION

The present invention generally relates to radio communication. More particularly, the invention relates to wideband multi-beam antennas for cellular communication systems.

BACKGROUND OF THE INVENTION

For common cellular applications where a given site has three sectors, each serviced by one antenna, each antenna usually has 65 degree azimuth Half Power Beamwidth (HPBW). Six sector cells may be employed at such sites to increase system capacity. Antennas with 33 degree and 45 degree HPBW are the most common for 6 sector applications. However, replacing three antennas with six antennas (each of which is 2 times wider than a common 65 degree antenna) is not a compact and low cost solution.

Dual-beam (or multi-beam antennas) may be used to reduce number of antennas on the tower. One key aspect of a multi-beam antenna is the beam forming network (BFN). An example of a known dual-beam antenna from prior art may be found in Encyclopedia for RF and Microwave engineering, 2005 John Wiley and Sons, pp. 335-339. In the known dual beam antenna, a two beam by two column (2×2) BFN is used. The main drawback of this prior art antenna is high levels of side and backlobes (about −10 dB), which is not acceptable for modern systems due high interference. Another drawback is poor coverage: more than 50% of radiated power is wasted out of the desired two 60 degree sectors.

Another dual-beam prior art solution may be found in U.S. Pat. No. 8,237,619. This example includes a three column array. However, it also has very high sidelobes (about −9 dB) and relatively narrow operational band (1.7-2.1 GHz). In modern telecommunication systems it is desirable to include the LTE 2.6 GHz band, and a cover a bandwidth of 1.69-2.69 GHz, which is about 2.5 times wider bandwidth than in known solutions.

Another dual-beam prior art solution is U.S. Patent Pub. No. 2011/0205119, which is incorporated by reference. In the '119 application, improved azimuth suppression and wideband operation is achieved by including different antenna sub-arrays into an antenna array. For example, the antenna may include a two beam by three column array and a two beam by two column array. However, bandwidth is also limited for this prior art solution.

Consequently, there is a need to provide an improved antenna, with more consistent HPBW across a wider frequency bandwidth, better azimuth sidelobe suppression, with better coverage of desired sector and less interference with other sectors.

SUMMARY OF THE INVENTION

In one example, a Frequency Dependent Divider (FDD) is included in the beam forming network for wideband beam forming and creation of frequency reconfigurable antennas.

The FDD, integrated in the beam forming network, provides for changes in amplitude distribution on array elements with respect to frequency.

The FDD may be configured to change the power ratio on its outputs with respect to frequency. For example, for lowest frequency, all power goes to port 1, for highest frequency all power goes to port 2, and for central frequency power is about equal for both ports of FDD. In one aspect of the invention, a new compact frequency-dependent divider is proposed, comprising 3 dB divider, 90 degree hybrid and delay line between them. But other schemes of FDD (for example, filters) may be used.

In another aspect of invention, a combination of 4 element and 5 element linear arrays is used to create a dual beam antenna with stabilized HPBW (+/−2 degree from nominal in 1.7 to 2.7 GHz), stabilized beam position (+/−1 degree from nominal) with low sidelobe level in azimuth an elevation plane for both beams.

According to one aspect of the invention, a wideband antenna includes a plurality of radiating elements arranged in an array and a feed network. The feed network has at least one input and a plurality of outputs coupled to the plurality of radiating elements. The feed network further includes at least one frequency dependent power divider for varying the amplitude of a signal provided to at least two of the plurality of radiating elements as a function of a frequency of a signal. In one example, the feed network increasingly tapers a power distribution to radiating elements at each end of the wideband array as a function of increasing frequency. Other power distribution schemes may also be advantageous and are described in the detailed description and drawings.

In another example, the feed network further comprises a plurality of inputs and the antenna produces a plurality of beams. For example, the feed network may further include a 90° hybrid having two inputs and the antenna produces two beams.

The frequency dependent divider may comprise a power divider having a first output and a second output, a 90° hybrid, having a first input coupled to the first output of the power divider, and a second input, and a delay line, coupled between the second output of the power divider and the second input of the 90° hybrid. The delay line may be a regular transmission line, a regular transmission line combined with a Shiffman phase shifter, a transmission line incorporating a series inductances and parallel capacitors, or other suitable structure.

In one example, a dual beam wideband array is provided. The array includes at least first, second and third radiating elements, the first, second and third radiating elements. A 90° hybrid having a first beam input and a second beam input is included. The 90° hybrid has a first output and a second output, the second output being coupled to the first radiating element. The array further includes a first frequency dependent power divider having an input coupled to the first output of the first 90° hybrid and a first output coupled to the second radiating element and a second output coupled to the third radiating element. The second output of the frequency dependent power divider is coupled to the third radiating element.

In one example, the dual beam wideband array consists of three radiating elements, and the second and third radiating elements are at opposite ends of the array. In another example, the dual beam wideband array consists of four radiating elements, and the second and third radiating elements are at one end of the array. In another example, The dual beam wideband array further includes a second frequency-dependent divider and a power divider coupling the first output of the 90° hybrid to the respective inputs of the first and second frequency dependent dividers, and the array further comprises a fourth radiating element and a fifth radiating element. The second frequency dependent divider is coupled to fourth and fifth radiating elements.

DETAILED DESCRIPTION

Figure 1A:
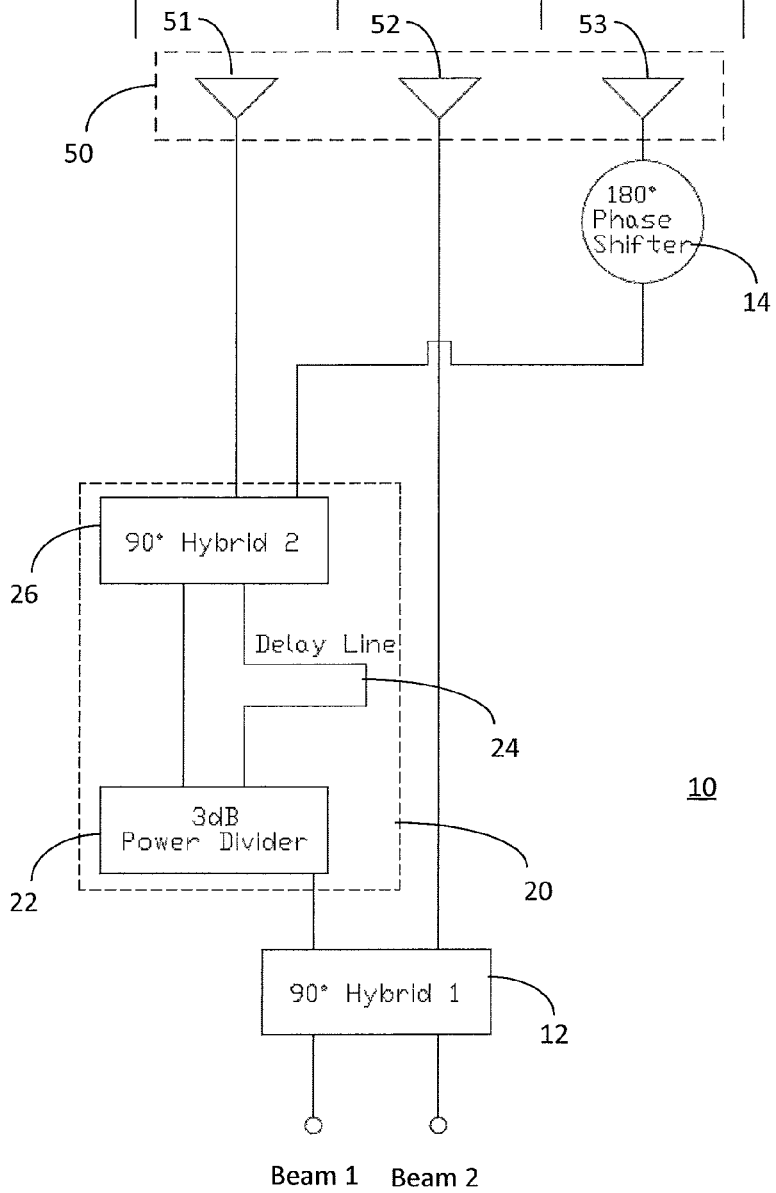
FIG. 1A is schematic diagram of a wideband beam forming network and array according to one aspect of the present invention.

One aspect of the present invention is to compensate for the array factor of a phased-array multi-beam antenna with changing frequency. For example, FIG. 1A shows schematic diagram of beam forming network 10 and an array 50 of three radiating elements 51, 52 and 53. This example accepts two inputs, Beam 1 and Beam 2, and produces two beams. The beam forming network 10 comprises a 90° hybrid 12, a frequency dependent divider 20, and a 180° phase shifter 14. Inputs Beam 1 and Beam 2 are input to 90° hybrid 12. A first output of hybrid 12 is coupled to the frequency dependent divider 20. A second output of hybrid 12 is coupled to a middle radiating element 52 of the array 50. Hybrid 12 may comprise a commercially available wideband 90° hybrids, for example Anaren X3C17-03WS-CT, which as a bandwidth of 690-2700 MHz, with almost constant 90° shift over all frequency band. The 3 dB power dividers, 16, 22 may be a multi-section Wilkinson dividers.

The frequency dependent divider 20 comprises a power divider 22, a delay line 24, and a 90° hybrid 26. The power divider 22 splits the signal from the first output of hybrid 12 into two signals. In this example, the power division of power divider 22 is equal. A first output of the power divider 22 is coupled to a first input of hybrid 26. A second output of the power divider 22 is coupled to the delay line 24. The output of delay line 24 is coupled to a second input of hybrid 26.

A first output of the frequency dependent divider 20 is coupled to radiating element 51. In this example, radiating element 51 is the first element in the array 50. The second output of the frequency dependent divider 20 is coupled to the third element of the array 50, radiating element 53, via 180° phase shifter 14. While 180° phase shifter 14 may be implemented as a discrete component, 180° phase shifter 14 may also be implemented by using a dipole radiator for the radiating element, and alternating the feedpoint relative to the other dipole elements.

Referring to the frequency dependent divider 20, the delay line 24 imposes a phase delay to a signal which coupled to the second input of hybrid 26. However, if the delay line is a fixed length, the phase delay experienced by a signal varies with frequency. That is, for a given fixed time delay, higher-frequency signals experience more phase delay than low frequency signals. Hybrid 26, therefore, receives equal amplitude signals, where the signals to one input experience increasing phase delay with increasing frequency. Hybrid 26 outputs equal phase, variable amplitude signals, where the amount of amplitude difference increases with increasing frequency.

With proper selection of delay line 24, HPBW can be stabilized over a desired frequency band. For example, amplitude ratio between outputs of the frequency dependent divider 20 (and the first and third radiating elements, 51, 52, of array 50) may be written as:

$$A1/A3=[(1-\sin\varphi)/(1+\sin\varphi)]^{1/2}$$

Or, $P1/P3=10\log[(1-\sin\varphi)/(1+\sin\varphi)]$ [dB], where $\varphi$ is electrical length of delay line. When $\varphi=0°$ or 180°, both elements have the same amplitude. When $\varphi=90°$ or 270°, one element has 0 amplitude, and another one amplitude 1.

In the example of FIG. 1A, the frequency dependent divider 20 is placed between radiating elements 51 and 53. The delay line is selected to be a regular transmission line with an electrical length of 180° for 1.7 GHz. For other frequencies y=233° for 2.2 GHz; 286° for 2.7 GHz. For both Beam 1 and Beam 2, beam forming network 10 provides a power distribution at radiating elements 51, 52 and 53, respectively, of 0.7, 1, and 0.7 at 1.7 GHz, 0.36, 1 and 0.88 at 2.2 GHz, and 0.14, 1 and 0.98 at 2.7 GHz. Beam forming network 10 also provides 90° phase differences between radiating elements to create two beams.

Figure 1B:
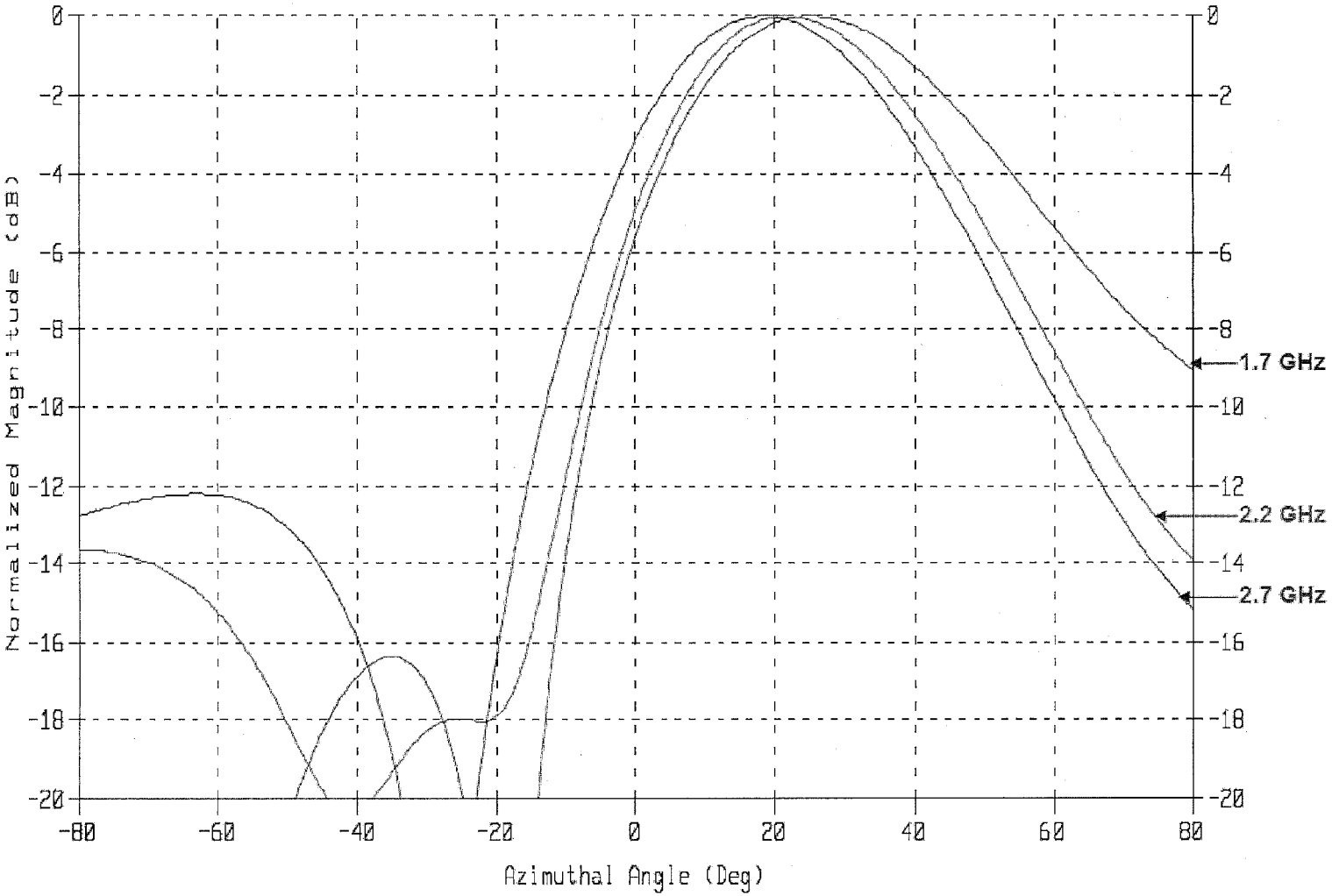
FIG. 1B illustrates a simulated radiation pattern of one beam produced by the beam forming network and array of FIG. 1A.

For FIG. 1B, results of a simulation of radiating patterns for one beam at three frequencies are shown. Spacing between elements for this example is selected at 80 mm and 60 mm. As one can see from FIG. 1B, HPBW is stabilized to 41+/−3° in this example.

Figure 2A:
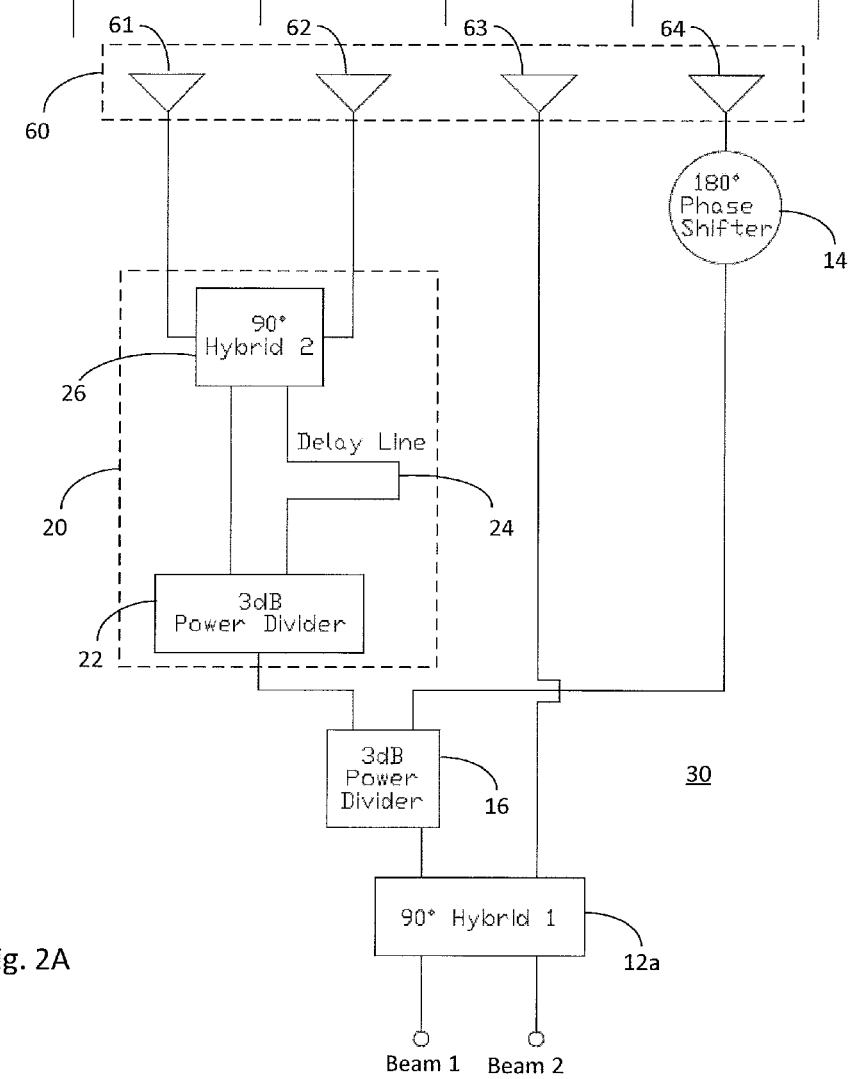
FIG. 2A is schematic diagram of another example of a beam forming network and array according to another aspect of the present invention.

Another aspect of the present invention is to compensate for the array factor and radiating element patters of a phased-array multi-beam antenna with changing frequency. For example, FIG. 2A illustrates a schematic diagram of another example of the present invention. Beam forming network 30 produces two beams via array 60 comprising radiating elements 61-64. Beam Forming Network 30 comprises a 90° hybrid 12*a*, or power divider 16, a frequency dependent divider 20, and 180° phase shifter 14. Hybrid 12*a* may comprise a non-equal 90° hybrid 1 (−3.8 dB, −2.4 dB) for improved sidelobe suppression.

Beam 1 and Beam 2 signals are input to hybrid 12*a*. A first output of hybrid 12*a* is coupled to power divider 16. A second output of hybrid 12*a* is coupled to radiating element 63 (the third radiating element of array 60). A first output of power divider 16 is coupled to frequency dependent divider 20. The first and second outputs of frequency dependent divider 20 are coupled to radiating elements 61 and 62 of array 60, respectively (the first and second elements of array 60). A second output of power divider 16 is coupled to 180° phase shifter 14, which is in turn coupled to radiating element 64.

In this example, the power tapering is frequency dependent for radiating elements 61 and 62, and not frequency dependent for radiating elements 63 and 64. In particular, in this example, delay line 24 is selected to have φ=270° for 1.7 GHz and 450° for 2.7 GHz. Amplitude and phase distribution is shown in FIG. 2A (above the radiating elements). In this example, the amplitude distribution at 1.7 GHz is 0.6, 0, 1, and 0.6 at radiating elements 61, 62, 63 and 64, respectively. Similarly, the amplitude distribution at 2.2 GHz is 0.45, 0.42, 1 and 0.6, and the amplitude distribution at 2.7 GHz is 0, 0.6, 1 and 0.6. Accordingly, at 1.7 GHz elements 1, 3, 4 are radiating, at 2.2 GHz all four elements are radiating, and at 2.7 GHz, elements 2, 3, 4 are radiating. That is, beam forming network 30, by reducing amplitude effectively to zero for some radiating elements at certain frequencies, effectively reconfigures Array 60 on a frequency-dependent basis. This feature of frequency re-configurability allows to stabilize beam width and beam position for both beams.

Figure 2B:
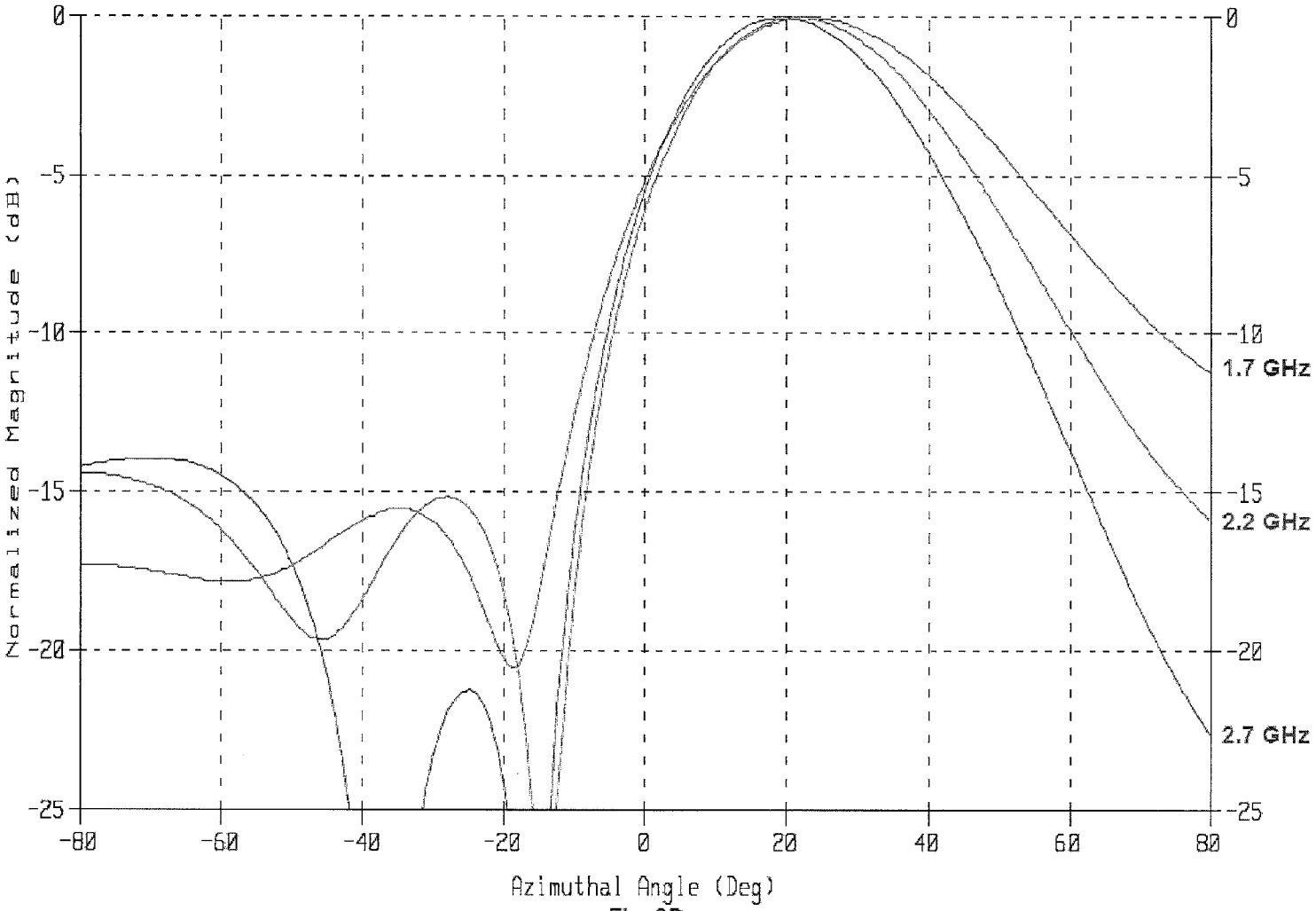
FIG. 2B illustrates a simulated radiation pattern one beam produced by the network illustrated in FIG. 2A.

Calculated radiation patterns are shown in FIG. 2B for 1.7, 2.2, 2.7 GHz (for one beam). As one can see from FIG. 2B, not only is HPBW is stabilized (36+/−4°), but also beam position is stabilized (21.5+/−1.5).

In another embodiment, all radiating elements of the Array 60 may be continue to be driven, but at different amplitudes at different frequencies. For example, at low frequency of operational bandwidth, central and periphery elements have almost the same amplitude (for example, 0.75; 1; 1; 0.75). For highest frequency of operational bandwidth, periphery elements have much lower amplitude (for example, 0.2; 1; 1; 0.2).

Figure 3A:
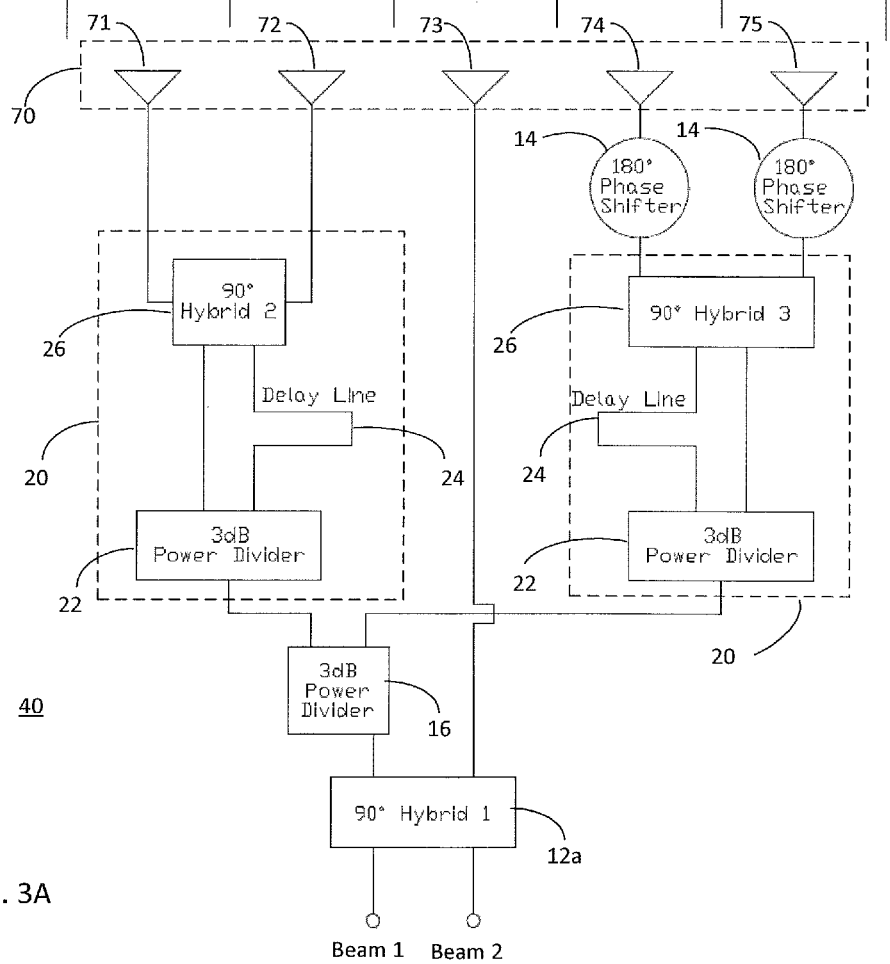
FIG. 3A is schematic diagram of another example of a beam forming network and array according to another aspect of the present invention.

FIG. 3A illustrates a schematic diagram of another example of the present invention. Beam forming network 40 produces two beams via array 70 comprising radiating elements 71-75. Beam forming network 40 comprises a 90° hybrid 12*a*, a power divider 16, two frequency dependent dividers 20, and two 180° phase shifters 14. Beam 1 and Beam 2 signals are input to hybrid 12*a*. A first output of hybrid 12*a* is coupled to power divider 16. A second output of hybrid 12*a* is coupled to radiating element 73 (the third radiating element of array 70). A first output of power divider 16 is coupled to a first frequency dependent divider 20. A second output of power divider 16 is coupled to a second frequency dependent divider 20. The first and second outputs of the first frequency dependent divider 20 are coupled to radiating elements 71 and 72 of array 70, respectively (the first and second elements of array 60). The first and second outputs of the second frequency dependent divider 20 are coupled to radiating elements 74 and 75 of array 70, respectively (the fourth and fifth elements of array 70).

The delay line 24 for both frequency dependent dividers 20 in this example comprises a transmission line with φ=283° at 1.7 GHz, 366° at 2.2 GHz, 450° at 2.7 GHz. For example, delay line 24 may comprise 50 Ohm microstrip line with ∈=3 and d=85 mm. Spacing between elements for this example is selected 8.0 mm and 60 mm. Hybrid 12*a* may comprise a non-equal 90° hybrid 12*a* (−3.8 dB, −2.4 dB) for improved sidelobe suppression (<−16 dB in this example).

Figure 3B:
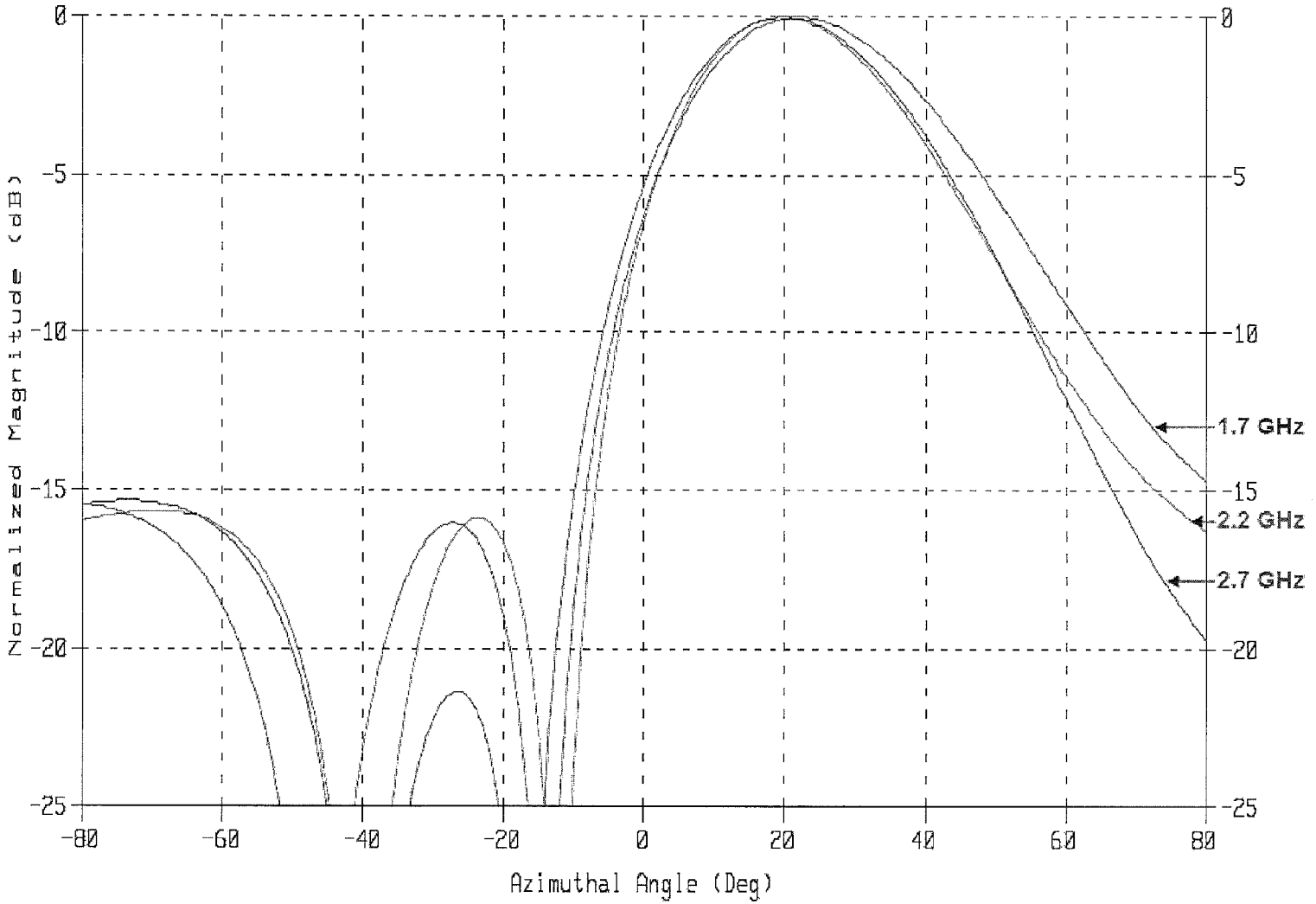
FIG. 3B illustrates a simulated radiation pattern of one beam produced by the beam forming network and array illustrated in FIG. 3A.
Figure 3C:
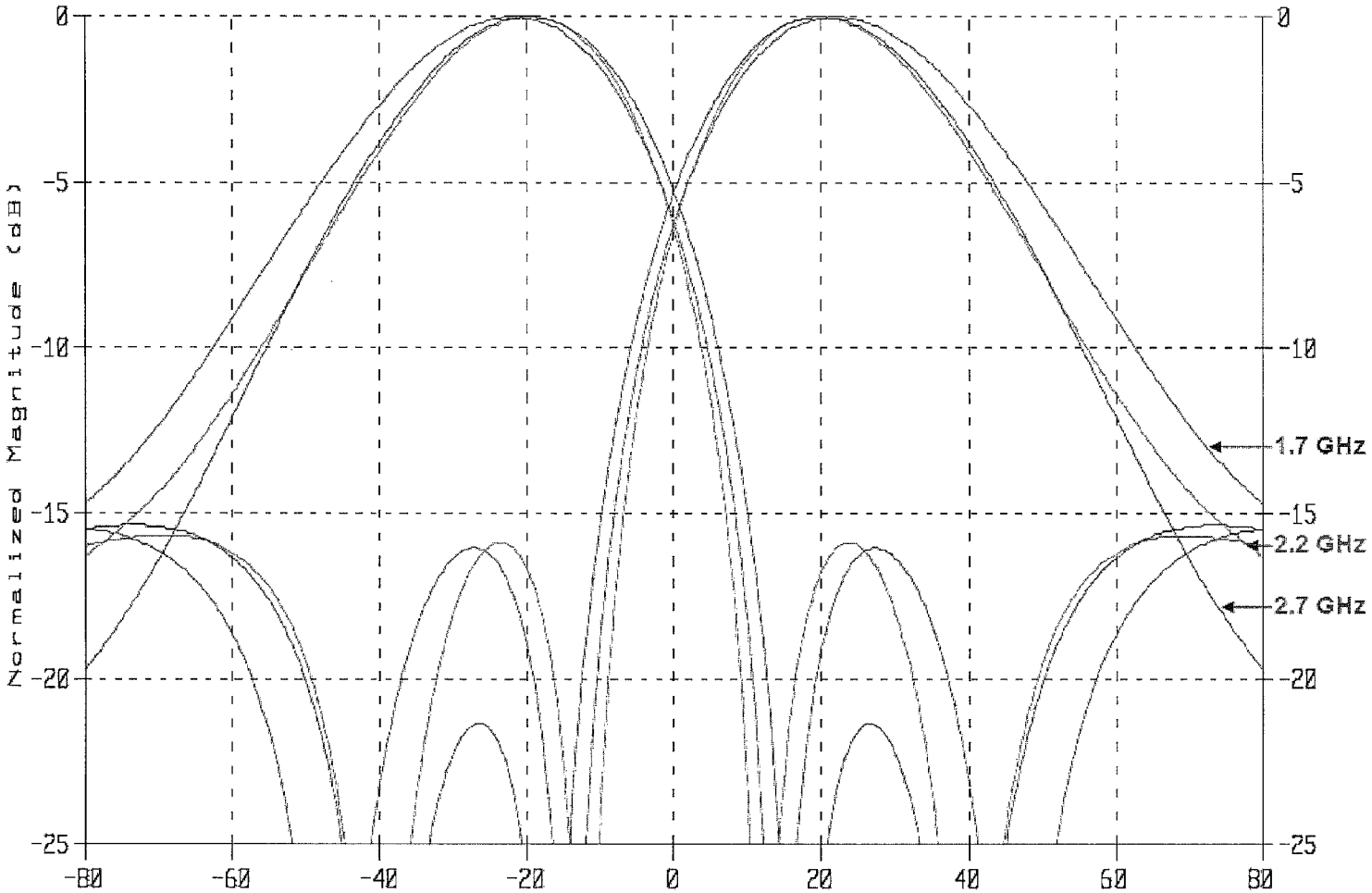
FIG. 3C illustrates simulated radiation patterns for two beams produced by the beam forming network and array illustrated in FIG. 3A.

Amplitude and phase distribution is shown in FIG. 3A (above the radiating elements), and calculated patterns are shown in FIG. 3B for 1.7, 2.2 and 2.7 GHz (for one beam) and in FIG. 3C (for both beams). In this example, at 1.7 GHz, the amplitude distribution is 0.55, 0.25, 1, 0.25, and 0.55 for radiating elements 71, 72, 73, 74, 75, respectively. Similarly, the amplitude distribution at 2.2 GHz is 0.36, 0.45, 1, 0.45 and 0.36, and the amplitude distribution at 2.7 GHz is 0, 0.6, 1, 0.6 and 0.

For low frequency (1.7 GHz), radiating elements 71, 73, and 75 are handling the most radio frequency energy. For mid-frequency (2.2 GHz), radiating elements 72, 73, 74 are handling the most radio frequency energy. For high frequency (2.7 GHz), radiating elements 72, 73 and 75 are handling all of the radio frequency energy, and radiating elements 71 and 75 are not radiating. Accordingly, this is another example of a frequency reconfigurable antenna. By selectively using different radiating elements at different frequencies, the effective aperture of array 70 is changing proportional to wavelength for both beams, providing almost constant HPBW and beam position angle.

The example of FIG. 3A is more complicated relative to the examples of FIG. 1A and FIG. 2A, but constant HPBW over wide (50%) bandwidth, constant beam position and low sidelobe level constitutes an improvement over the prior art. For example, HPBW and beam position are very stable: 34+/−2° and 21+/−1°, respectively. The beam width and beam position tolerances are about 10 times better than in prior art (U.S. Pat. No. 8,237,619, FIG. 2, FIG. 3: HPBW=40+/−7° and beam position 20+/−4° for twice less frequency band, 1.7-2.2 GHz only with high sidelobes (−9 dB).

In the above examples, beam forming networks were shown for 1.7-2.7 GHz, but the invention is not limited to this frequency band and may be implemented using any other frequencies.

Figure 4A:
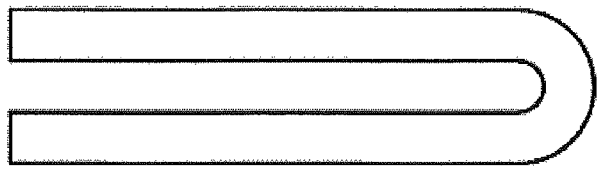
FIG. 4A illustrates a first example of a delay line according to one aspect of the present invention.
Figure 4B:
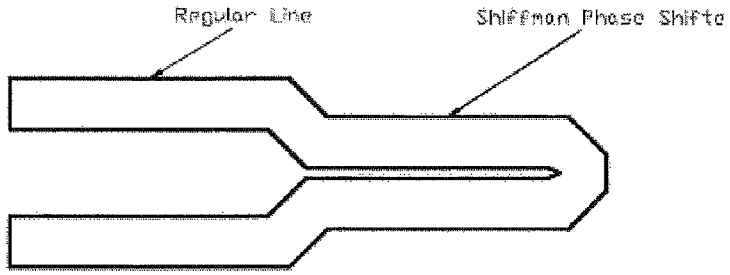
FIG. 4B illustrates a second example of a delay line according to one aspect of the present invention.
Figure 4C:
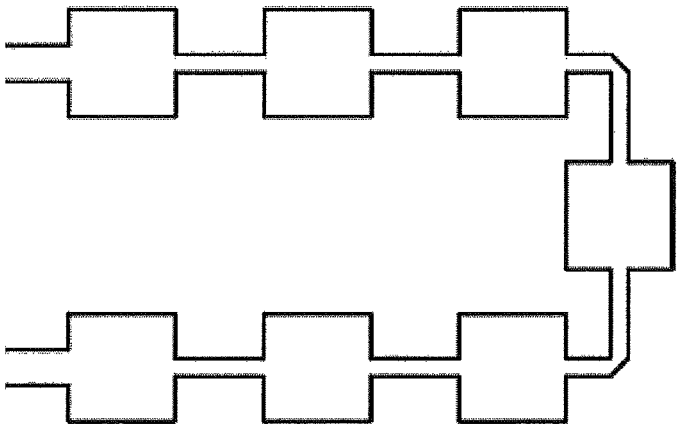
FIG. 4C illustrates a third example of a delay line according to one aspect of the present invention.

Various delay line 24 may be advantageous in various applications. For example, FIGS. 4A, 4B and 4C illustrate three different variations of delay lines. FIG. 4A illustrates a regular transmission line, where phase delay is directly proportional to frequency. For example, it can be 50 Ohm microstrip line with length d, and $\varphi=[2\pi(\in e^{1/2})]/\lambda$, where ∈e—effective dielectric constant of substrate material. This line may be used for the example illustrated in FIG. 1A (φ=180° 1.7) GHz and for FIG. 3 (φ=283° GHz 1.7).

FIG. 4B illustrates a delay line comprising a regular transmission line combined with a Shiffman phase shifter. Because a Shiffman phase shifter provides constant phase over frequency band, phase for this delay line will change more slowly with frequency compared to a regular transmission line as illustrated in FIG. 4A.

FIG. 4C shows a loaded line, where narrow sections (series inductances) are combined with wide sections (parallel capacitances), providing 15-30% "faster" phase change compare to regular line. The example of FIG. 4C may be used, for example, to create amplitude distribution shown in the example of FIG. 2A: φ (1.7 GHz)=270° and φ (2.7 GHz)=450°.

By using different style of delay line, it is possible to provide desirable dependence of amplitude distribution against frequency, and get optimization of beam position, beam width and sidelobes.

Wideband 180° phase shifter 14 may be easy realized with dipole radiator, by alternating feedpoint (for 0°, central conductor of feed line is connected to $1^{st}$ dipole arm, for 180°, it is connected to $2^{nd}$ dipole arm). This solution provides constant 180° phase shift over whole frequency band without having to add a discrete phase shifter component.

Figure 5D:
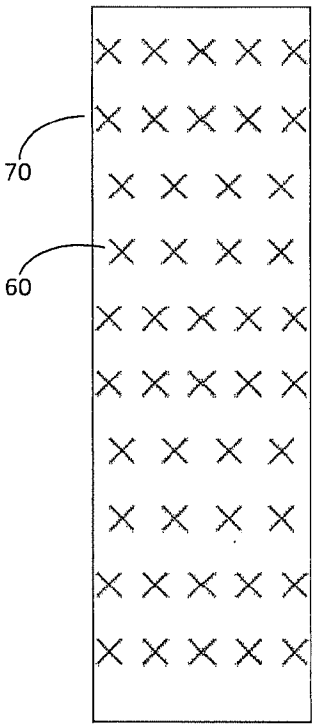
FIG. 5D illustrates a fourth example of how beam forming networks according to the present invention and having different numbers of radiating elements may be combined in an antenna array.
Figure 5C:
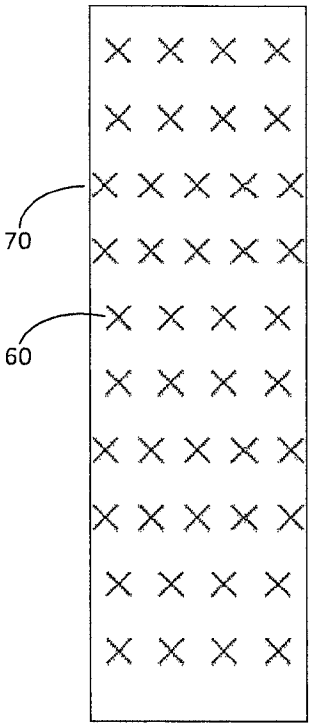
FIG. 5C illustrates a third example of how beam forming networks according to the present invention and having different numbers of radiating elements may be combined in an antenna array.
Figure 5B:
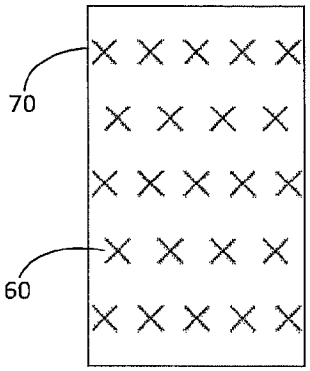
FIG. 5B illustrates a second example of how beam forming networks according to the present invention and having different numbers of radiating elements may be combined in an antenna array.
Figure 5A:
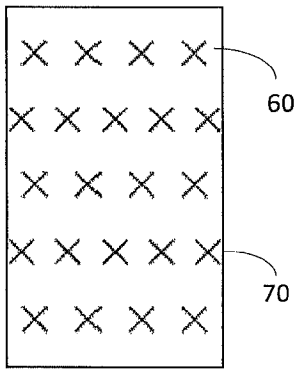
FIG. 5A illustrates a first example of how beam forming networks according to the present invention and having different numbers of radiating elements may be combined in an antenna array.

In a full array, a combination of 3, 4 and 5 element linear arrays as described in FIGS. 1A, 2A, 3A may be implemented. Such combinations may be advantageously used to reduce azimuth sidelobe level. For example, FIGS. 5A and 5B illustrate alternating five element arrays 70 and four element arrays 60. FIGS. 5C and 5D illustrate alternating pairs of five element arrays 70 and four element arrays 60. Also, for further sidelobes' and beam shape optimization, horizontal spacing between elements can also be different. Examples shown in FIG. 5 are related to antennas with +/−45 degree dual polarization (most common in base station antenna technology), but of course the same solutions can be applied to antennas with any single or dual polarization.

What is claimed is:

1. A wideband antenna array, comprising:

a plurality of radiating elements arranged in an array; and a feed network coupled to the plurality of radiating elements, the feed network further comprising at least one frequency dependent power divider;

wherein the frequency dependent power divider is configured to vary an amplitude ratio between output signals provided to at least two of the plurality of radiating elements as a function of a frequency of an input signal;

wherein the feed network further comprises a first 90° hybrid comprising two inputs, the input signal being received on a first one of the two inputs, a first output coupled to a first one of the plurality of radiating elements, and a second output; and wherein the frequency dependent power divider comprises:

a power divider comprising a first input coupled to the second output of the first 90° hybrid, a first output, and a second output;

a second 90° hybrid having a first input coupled to the first output of the power divider, a second input, a first output coupled to a second one of the plurality of radiating elements, and a second output coupled to a third one of the plurality of radiating elements; and a delay line coupled between the second output of the power divider and the second input of the second 90° hybrid.

2. The wideband antenna array of claim 1, wherein the feed network increasingly tapers a power distribution to radiating elements at each end of the wideband array as a function of increasing frequency.

3. The wideband antenna array of claim 1, wherein the antenna array is configured to produce a plurality of beams.

4. The wideband antenna array of claim 1, wherein the antenna array is configured to produce two beams.

5. The wideband antenna array of claim 1, wherein the delay line is a regular transmission line.

6. The wideband antenna array of claim 1, wherein the delay line is a regular transmission line combined with a Shiffman phase shifter.

7. The wideband antenna array of claim 1, wherein the delay line comprises series inductances and parallel capacitors.

8. A dual beam wideband array, comprising:

at least first, second and third radiating elements, the first, second and third radiating elements comprising an array;

a first 90° hybrid having a first beam input and a second beam input, the 90° hybrid further having a first output and a second output, the second output being coupled to the first radiating element; and a first frequency dependent power divider comprising:

a power divider comprising a first input coupled to the first output of the first 90° hybrid, a first output, and a second output;

a second 90° hybrid having a first input coupled to the first output of the power divider, a second input, a first output coupled to the second radiating element, and a second output coupled to the third radiating element; and a delay line coupled between the second output of the power divider and the second input of the second 90° hybrid.

9. The dual beam wideband array of claim 8, wherein the second and third radiating elements being located at opposite ends of the array, and the second output of the first frequency dependent power divider is coupled to the third radiating element with a 180° phase shift.

10. The dual beam wideband array of claim 8, wherein the array comprises four radiating elements, and the second and third radiating elements are positioned at opposing ends of the array.

11. The dual beam wideband array of claim 8, wherein the power divider is a first power divider, the dual beam wideband array further comprising:

a second frequency dependent power divider; and a second power divider, the second power divider coupling the first output of the first 90° hybrid to the first input of the first power divider and an input of the second frequency dependent power divider; and a fourth radiating element and a fifth radiating element;

wherein the second frequency dependent power divider is coupled to the fourth and the fifth radiating elements with respective intervening 180° phase shifts.

12. The dual beam wideband array of claim 8, where directly adjacent ones of the at least first, second, and third radiating elements are spaced apart from one another at unequal distances, respectively.

13. The dual beam wideband array of claim 9, further comprising a plurality of arrays each including a different number of radiating elements.

14. The wideband antenna array of claim 1, wherein the amplitude ratio is given by $A1/A3=[(1-\sin\varphi)/(1+\sin\varphi)]^{1/2}$, wherein $\varphi$ comprises a phase delay applied to the signal provided to the input of the frequency dependent power divider, and wherein A1 is an amplitude of a first output signal from the dependent power divider provided to the first radiator and A3 is an amplitude of a second output signal from the frequency dependent power divider provided to the third radiator.

15. The dual beam wideband array of claim 8, wherein the first frequency dependent power divider is configured to vary an amplitude ratio between respective signals at the first and second outputs of the second 90° hybrid as a function of a frequency of a signal provided to the first input of the power divider.

16. The dual beam wideband array of claim 15 wherein the amplitude ratio is given by A1/A3=[(1−sin φ)/(1+sin φ)]½, wherein φ comprises a phase delay applied to the signal provided to the first input of the power divider, and wherein A1 is an amplitude of a first output signal from the first output of the second 90° hybrid provided to the second radiating element and A3 is an amplitude of a second output signal from the second output of the second 90° hybrid provided to the third radiating element.

17. A wideband antenna, comprising:

a frequency dependent power divider that is configured to receive an input signal, split the received input signal into first and second output components, wherein a ratio of an amplitude of the first output component to the second output component varies based on a frequency of the input signal; and a first radiating element; and;

a second radiating element, wherein the frequency dependent power divider comprises:

a power divider comprising a first input configured to receive the input signal, a first output, and a second output;

a first 90° hybrid having a first input coupled to the first output of the power divider, a second input, a first output coupled to the first radiating element, and a second output to the second radiating element; and a delay line coupled between the second output of the power divider and the second input of the first 90° hybrid;

wherein the first and second radiating elements are part of an array of radiating elements.

18. The wideband antenna of claim 17, further comprising a second 90 degree hybrid and a third radiating element that is part of the array of radiating elements, wherein the first input of the power divider is coupled to a first output of the second 90 degree hybrid and the third radiating element is coupled to a second output of the second 90 degree hybrid.

19. The wideband antenna array of claim 1, wherein the wideband antenna array comprises a wideband dual beam antenna array, where the second 90° hybrid provides constant 90° phase shift over a wide frequency band.

20. The wideband antenna array of claim 7, wherein the wideband antenna array comprises a wideband dual beam antenna array, wherein the delay line comprises a periodic structure including short sections of wide microstrip line and short sections of narrow microstrip line.

21. The dual beam wideband array of claim 11, wherein the second and fourth radiating elements have smaller respective footprints compared to the first and fifth radiating elements.

22. The dual beam wideband array of claim 11 wherein the radiating elements are arranged in a zig-zag layout.

23. The dual beam wideband array of claim 11, wherein the radiating elements are dual-polarized.

* * * * *